US010320124B1

(12) United States Patent
Yang

(10) Patent No.: US 10,320,124 B1
(45) Date of Patent: Jun. 11, 2019

(54) ELECTRICAL CONNECTOR WITH INTERNAL TERMINALS HAVING OPPOSITE SIDES LOCATED FROM CONNECTOR INTERNAL SIDEWALLS

(71) Applicant: ALL BEST PRECISION TECHNOLOGY CO., LTD., Taoyuan (TW)

(72) Inventor: Haven Yang, Taoyuan (TW)

(73) Assignee: ALL BEST PRECISION TECHNOLOGY CO., LTD., Taoyuan (TW)

( * ) Notice: Subject to any disclaimer, the term of this patent is extended or adjusted under 35 U.S.C. 154(b) by 0 days.

(21) Appl. No.: 15/969,752

(22) Filed: May 2, 2018

(51) Int. Cl.

| | |
|---|---|
| ***H01R 13/6474*** | (2011.01) |
| ***H01R 13/422*** | (2006.01) |
| *H01R 12/70* | (2011.01) |
| *H01R 13/05* | (2006.01) |

(52) U.S. Cl.
CPC ..... *H01R 13/6474* (2013.01); *H01R 13/422* (2013.01); *H01R 12/707* (2013.01); *H01R 13/057* (2013.01)

(58) Field of Classification Search
CPC ..... H01R 13/6474; H01R 13/428; H01R 13/422; H01R 13/05; H01R 12/585
USPC ..... 439/733.1, 751
See application file for complete search history.

(56) References Cited

U.S. PATENT DOCUMENTS

| | | | | |
|---|---|---|---|---|
| 6,565,392 | B2 * | 5/2003 | Padro | H01R 13/428 439/751 |
| 7,021,975 | B2 * | 4/2006 | Lappohn | H01R 13/41 439/733.1 |
| 7,329,154 | B2 * | 2/2008 | Koyama | H01R 23/10 439/353 |
| 7,465,194 | B1 * | 12/2008 | Ho | H01R 9/032 439/607.01 |
| 7,744,431 | B2 * | 6/2010 | Trout | H01R 13/112 439/733.1 |
| 7,771,236 | B2 * | 8/2010 | Koyama | H01R 13/6275 439/607.53 |
| 7,988,501 | B2 * | 8/2011 | Chang | H05K 7/1069 439/751 |
| 8,545,240 | B2 * | 10/2013 | Casher | H01R 29/00 439/108 |
| 8,764,488 | B2 * | 7/2014 | Zeng | H01R 13/6585 439/108 |
| 9,431,733 | B1 * | 8/2016 | Heistand | H01R 43/16 |
| 9,634,407 | B2 * | 4/2017 | Endo | H01R 12/585 |

(Continued)

*Primary Examiner* — Tulsidas C Patel
*Assistant Examiner* — Peter G Leigh
(74) *Attorney, Agent, or Firm* — Winston Hsu

(57) ABSTRACT

An electrical connector includes an insulation housing and at least one terminal. The insulation housing has a fixing hole that has a first inner sidewall and a second inner sidewall opposite to the first inner sidewall. The terminal includes a contact portion, a fixed portion, and a connection portion. The contact portion and the connection portion extend from the fixed portion respectively and are exposed out of the insulation housing. The fixed portion has a first side surface and a second side surface opposite to the first side surface. The fixed portion has a through hole. The fixed portion is fixed in the fixing hole with the through hole located in the fixing hole. The first and second side surfaces face the first and second inner sidewalls and are kept apart from the first and second inner sidewalls respectively.

15 Claims, 10 Drawing Sheets

(56) References Cited

U.S. PATENT DOCUMENTS

| | | | | |
|---|---|---|---|---|
| 9,634,432 | B2 * | 4/2017 | Su | H01R 13/6461 |
| 9,640,915 | B2 * | 5/2017 | Phillips | H01R 13/6471 |
| 2007/0141890 | A1 * | 6/2007 | Koyama | H01R 23/10 439/358 |
| 2017/0229798 | A1 * | 8/2017 | Shimizu | H01R 12/585 |

* cited by examiner

ELECTRICAL CONNECTOR WITH INTERNAL TERMINALS HAVING OPPOSITE SIDES LOCATED FROM CONNECTOR INTERNAL SIDEWALLS

BACKGROUND OF THE INVENTION

1. Field of the Invention

The invention relates to an electrical connector, and especially relates to an electrical connector with tuned impedance terminals.

2. Description of the Prior Art

Electrical connectors are widely used in various electronic devices. By the electrical connectors, electronic devices or components in an electronic device can be electrically connected and transmit signals therebetween. As the frequency for transmitting signals becomes higher, the impedance of the electrical connector produces an increasing effect on the signal transmission. Under a condition of high frequency transmission, when an electrical connector is not impedance matched with a transmission line, the electrical connector will reflect signals, leading to signal decay. The higher the extent of the impedance mismatch becomes, the worse the signal decay becomes. Even the signal transmission is failed. The structure designs of current electrical connectors are usually based on the mechanical properties of the electrical connectors, e.g. insertion force, withdrawal force, and durability. For the electrical properties of the electrical connectors, the design therefor is usually done by experience. In a common structure design for an electrical connector, when the electrical connector cannot meet the impedance requirement therefor, the electrical connector needs to be modified in the structural sizes of the insulation housing and the conductive terminals thereof. It wastes time and increases the cost for making the electrical connector.

SUMMARY OF THE INVENTION

An objective of the invention is to provide an electrical connector, of which a conductive terminal has a through hole, located at a portion of the conductive terminal fixed in an insulation housing of the electrical connector, and side surfaces, kept away from inner sidewalls of the insulation housing. The structure design is conducive to an adjustment to the impedance of the electrical connector.

An electrical connector according to the invention includes an insulation housing and a terminal. The insulation housing has a fixing hole. The first fixing hole has a first inner sidewall and a second inner sidewall opposite to the first inner sidewall. The first terminal includes a contact portion, a fixed portion, and a connection portion. The contact portion and the connection portion extend from the fixed portion respectively and are exposed out of the insulation housing. The fixed portion has a first side surface and a second side surface opposite to the first side surface in a direction. The fixed portion has a through hole. The fixed portion is fixed in the fixing hole. The through hole is located in the fixing hole. The first side surface faces the first inner sidewall and is kept away from the first inner sidewall by a first distance. The second side surface faces the second inner sidewall and is kept away from the second inner sidewall by a second distance. Thereby, in practice, the impedance of the electrical connector can be adjusted by changing the size of the fixed portion relative to the through hole (e.g. the outlines of the fixed portion and the hole dimension of the through hole in a direction perpendicular to the direction) or changing the first distance and the second distance.

Another object of the invention is to provide a terminal for being used in an electrical connector. The terminal has a through hole located at a portion thereof fixed in an insulation housing of the electrical connector, which is conducive to an adjustment to the impedance of the electrical connector.

A terminal according to the invention includes a fixed portion, a contact portion, and a connection portion. The fixed portion has a first side surface and a second side surface opposite to the first side surface in a first direction. The fixed portion includes an abutting portion and a through hole. The abutting portion protrudes in a second direction perpendicular to the first direction. The first through hole is located at the first abutting portion and passes through the first side surface and the second side surface. Therein, the fixed portion is fixed in the electrical connector through the abutting portion. The contact portion extends from the fixed portion extend. The connection portion extends from the fixed portion. Thereby, in practice, the impedance of the electrical connector can be adjusted by changing the size of the through hole and the profile of the abutting portion.

Compared with the prior art, the electrical connector and the terminal according to the invention can be modified by changing the size of the fixed portion (e.g. the profile of the abutting portion, the hole dimension of the through hole and so on) or changing the first distance and the second distance, so as to adjust the impedance of the electrical connector. The structure design facilitate adjustment to the impedance of the electrical, which is conducive to reduction of cost and development time and effectively solves the problem in the prior art.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
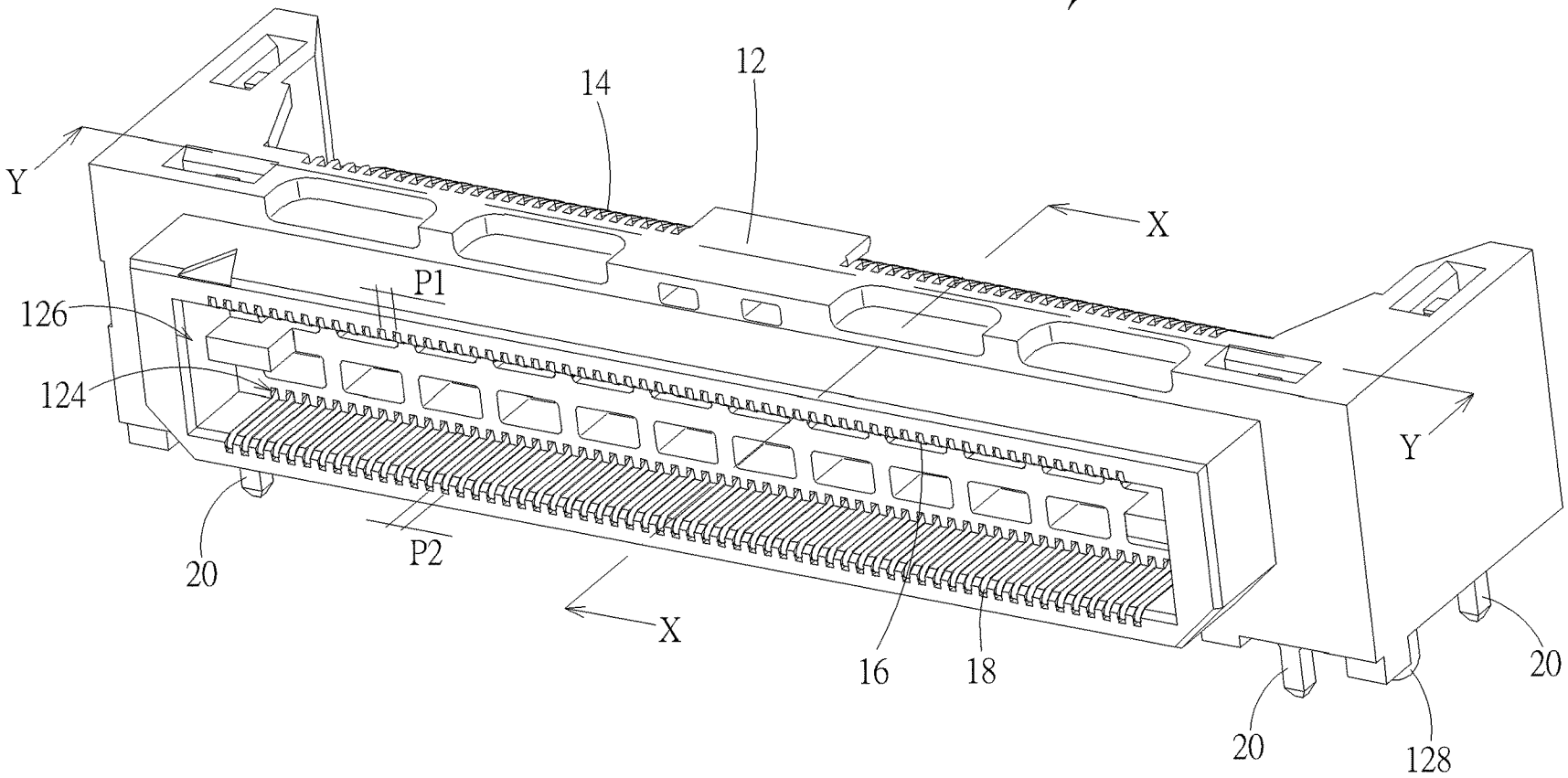
FIG. 1 is a schematic diagram illustrating an electrical connector of an embodiment according to the invention.
Figure 2:
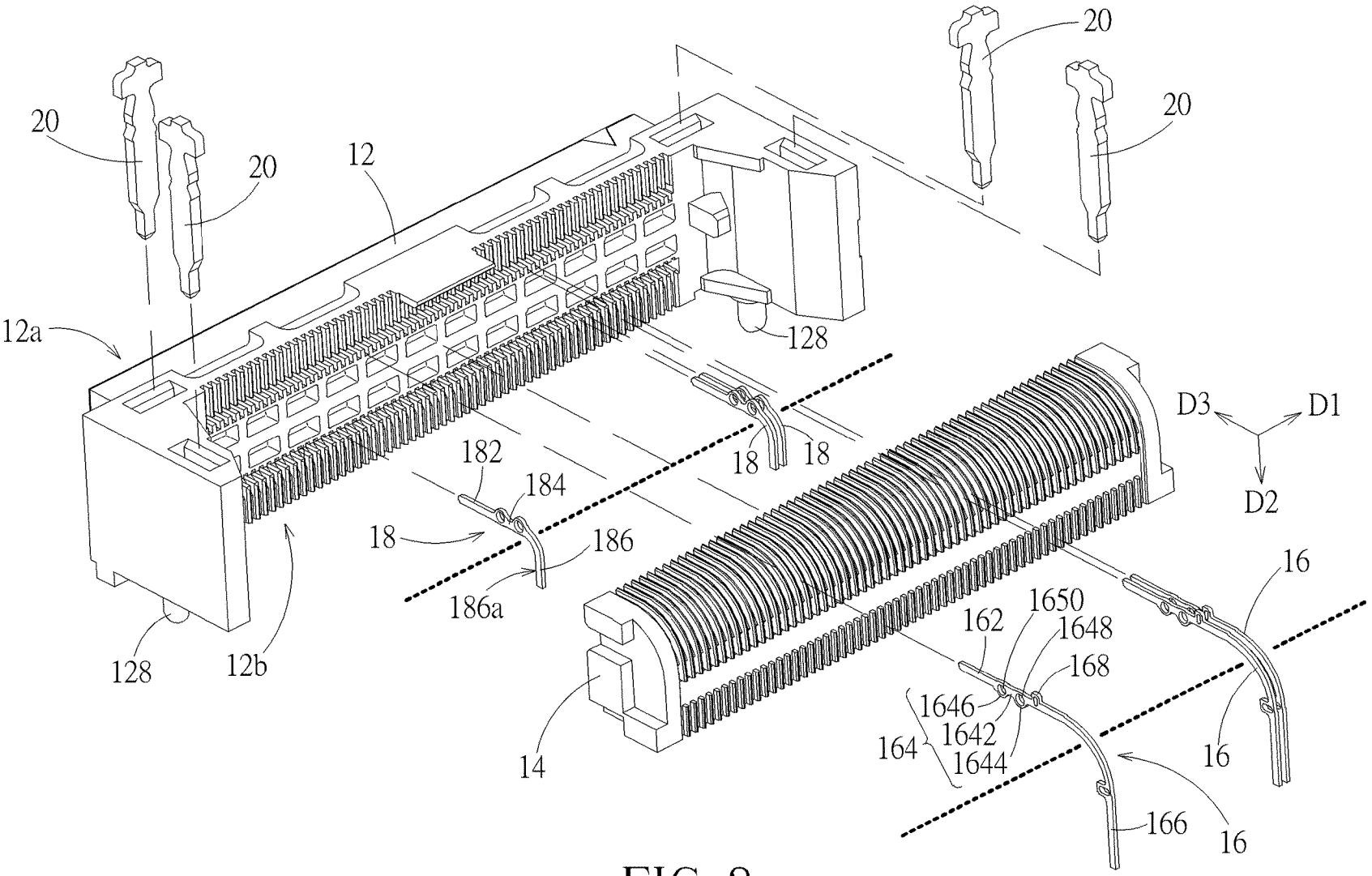
FIG. 2 is an exploded view of the electrical connector in FIG. 1.
Figure 3:
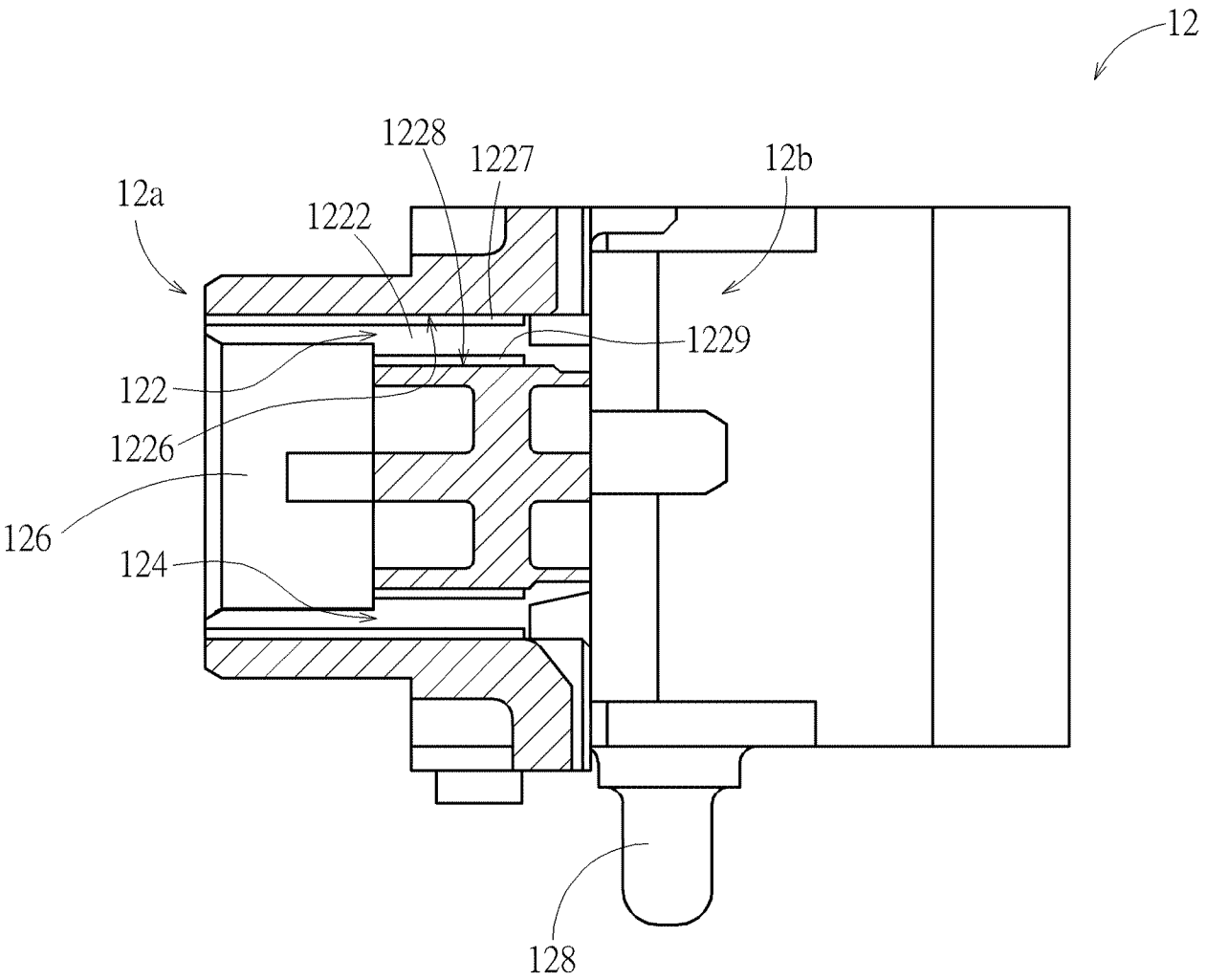
FIG. 3 is a sectional view of an insulation housing of the electrical connector along the line X-X in FIG. 1.
Figure 4:
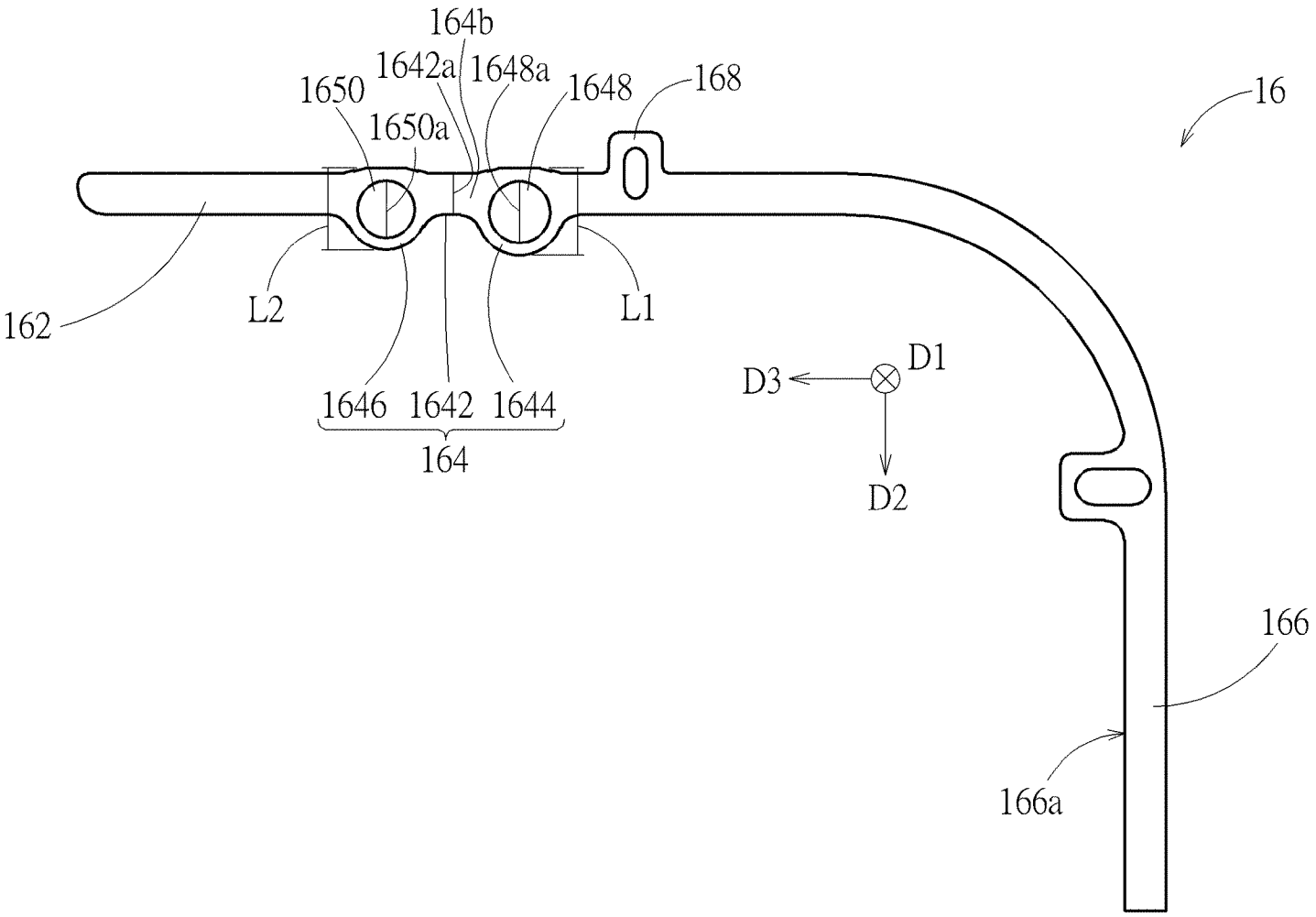
FIG. 4 is a side view of an upper row terminal of the electrical connector in FIG. 1.
Figure 5:
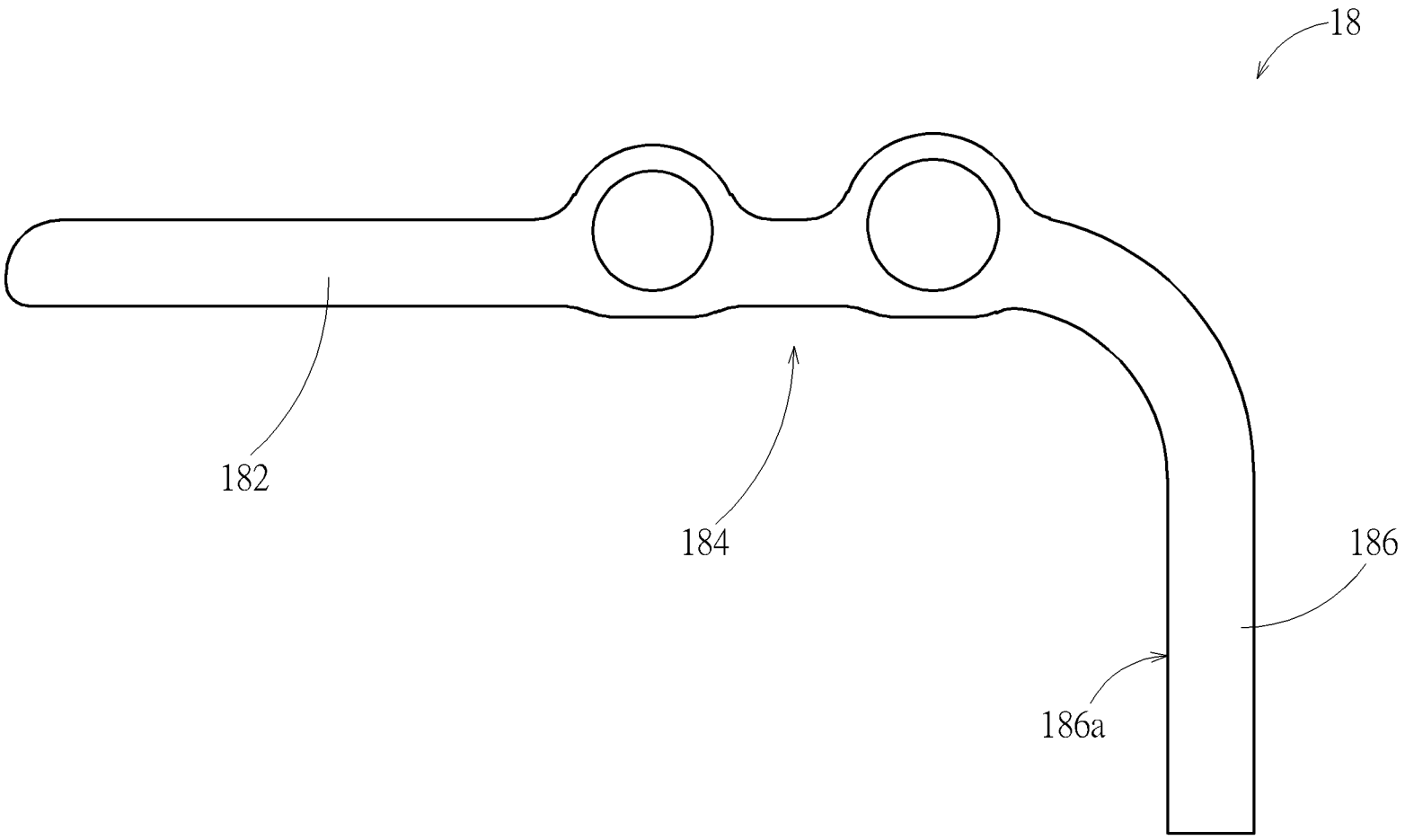
FIG. 5 is a side view of a lower row terminal of the electrical connector in FIG. 1.
Figure 6:
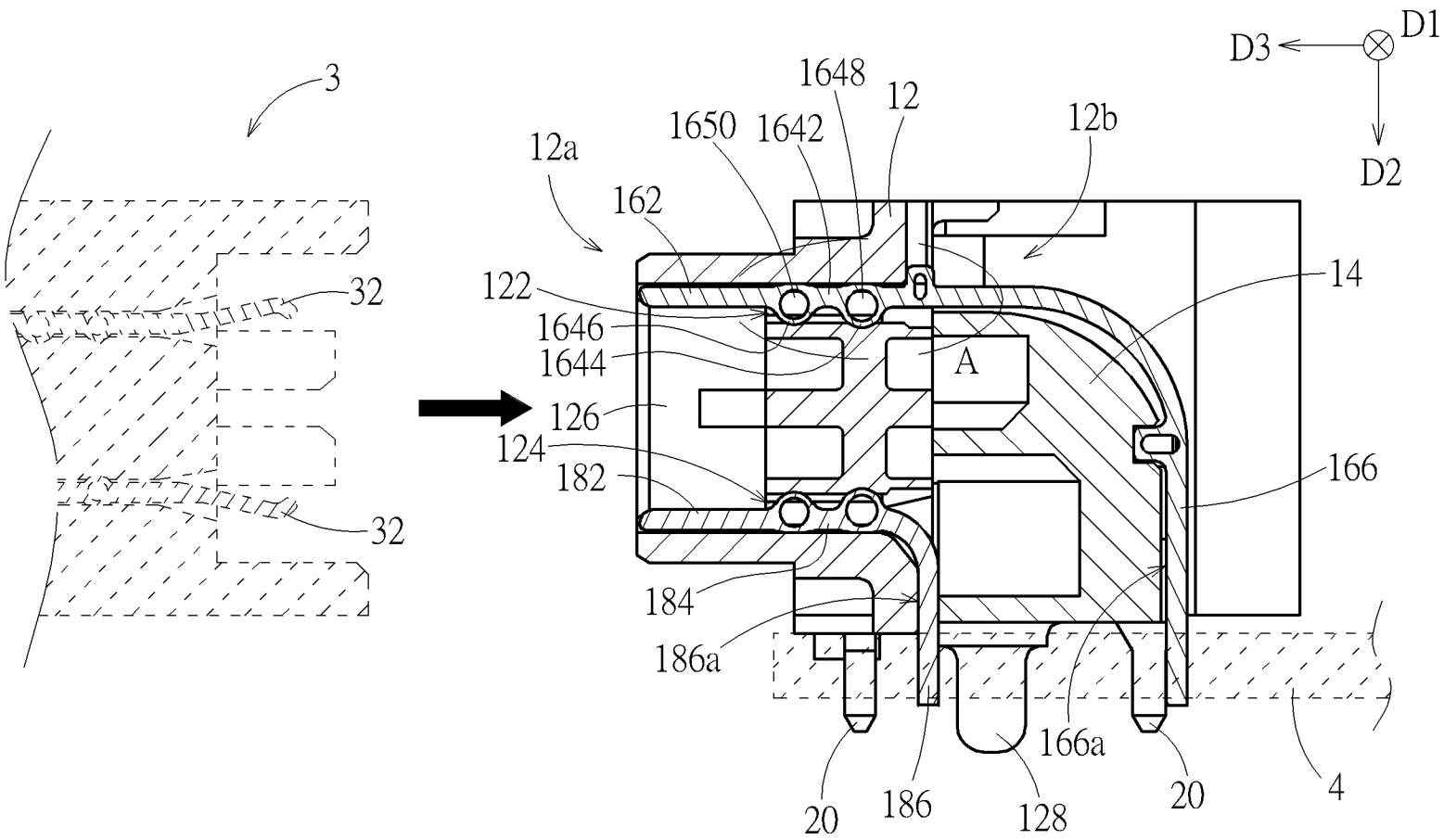
FIG. 6 is a sectional view of the electrical connector along the line X-X in FIG. 1.

Please refer to FIG. 1 to FIG. 6. An electrical connector of an embodiment according to the invention includes an insulation housing 12, a rear cover 14, a plurality of upper row terminals 16, and a plurality of lower row terminals 18 (of which only several are shown in FIG. 2 for drawing simplification). The insulation housing 12 (e.g. but not limited to a plastic injection part) has a plurality of upper row fixing holes 122 and a plurality of lower row fixing holes 124, which are arranged in parallel and correspond to the plurality of upper row terminals 16 and the plurality of lower row terminals respectively. The upper row terminal 16 includes a contact portion 162, a fixed portion 164, and a connection portion 166. The contact portion 162 and the connection portion 166 extend from the fixed portion 164 respectively. The upper row terminal is fixed in the corresponding upper row fixing hole 122 through the fixed portion 164 such that the contact portion 162 and the connection portion 166 are exposed out of the insulation housing 12. Similarly, the lower row terminal 18 includes a contact portion 182, a fixed portion 184, and a connection portion 186. The contact portion 182 and the connection portion 186 extend from the fixed portion 184 respectively. The lower row terminal 18 is fixed in the corresponding lower row fixing hole 124 through the fixed portion 184 such that the contact portion 182 and the connection portion 186 are exposed out of a front side 12*a* and a rear side 12*b* of the insulation housing 12 respectively.

In the embodiment, the electrical connector 1 is a female board electrical connector. The insulation housing 12 has a front side 12*a* and a rear side 12*b*. The insulation housing 12 has a socket 126 at the front side 12*a*. The upper row fixing holes 122 and the lower row fixing holes 124 passes through the insulation housing 12 to connect the front side 12*a* and the rear side 12*b*, so that the contact portions 162 of the upper row terminals 16 and the contact portions 182 of the lower row terminals 18 are exposed in the socket 126 (i.e. exposed out of the insulation housing 12 at the front side 12*a*). In an application, a mating male electrical connector 3 (shown in dashed lines in FIG. 6) can be inserted into the socket 126 (the insertion direction therefor being indicated by an arrow in FIG. 6) such that conductive terminals 32 of the electrical connector electrically contact the conductive upper row and lower row terminals 16 and 18, which achieves connection of the electrical connectors 1 and 3 (including mechanical connection and electrical connection). Therein, the male electrical connector 3 can be a board electrical connector, a cable connector, or even an adapter. Furthermore, in the embodiment, the connection portion 166 of the upper row terminal 16 and the connection portion 186 of the lower row terminal 18 are exposed out of the insulation housing 12 at the rear side 12*b* and bend downward to be capable of being fixed to a circuit board 4 (shown by dashed lines in FIG. 6) through but not limited to through-hole technology (e.g. surface-mount technology). Therein, the insulation housing 12 has two locating posts 128 at its bottom which protrude downward. The locating posts 128 can be inserted into locating holes of the circuit board 4 (not shown in FIG. 6). The electrical connector 1 also includes a plurality of fixing parts 20 (e.g. made of metal) which are connected to the insulation housing 12 and extend downward to be capable of being inserted into fixing holes of the circuit board 4 (not shown in FIG. 6) and fixed (e.g. by soldering). The fixing parts 20 perform locating and fixing effects.

Figure 7:
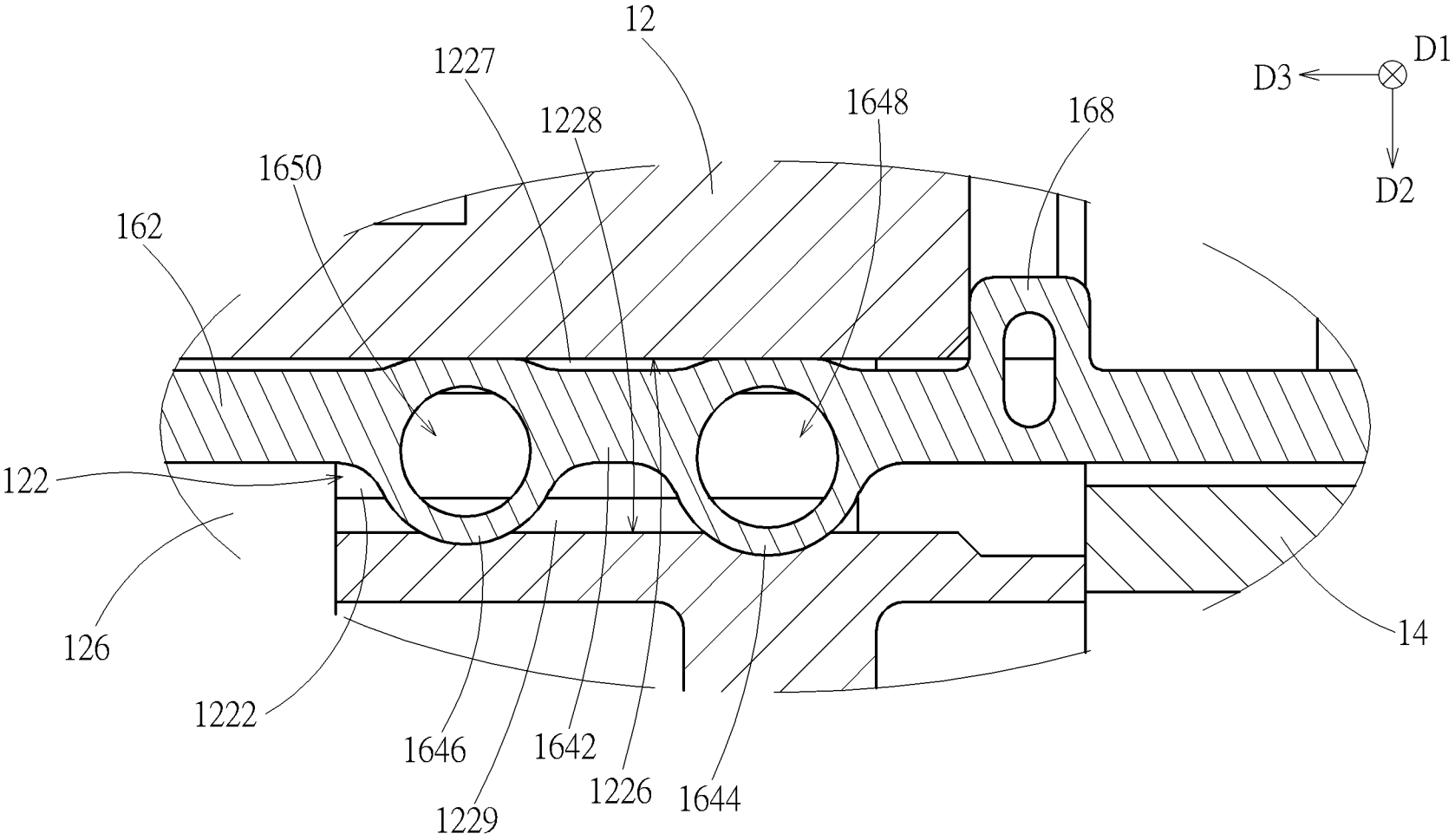
FIG. 7 is an enlarged view of the circle A in FIG. 6.

In the embodiment, the upper row terminal 16 and the lower row terminal 18 are structurally similar; the upper row fixing hole 122 and the lower row fixing hole 124 are also structurally similar. Therefore, the following descriptions are based on the upper row terminal 16 and the upper row fixing hole 122. For descriptions about the lower row terminal 18 and the lower row fixing hole 124, except for additional descriptions, please refer to the relevant descriptions of the upper row terminal 16 and the upper row fixing hole 122, which will not be described in addition. Please also refer to FIG. 7 and FIG. 8. The fixed portion 164 of the upper row terminal 16 has a first side surface 164*a* and a second side surface 164*b* opposite to the first side surface 164*a* in a first direction D1. The fixed portion 164 includes a main body 1642, a first abutting portion 1644, and a second abutting portion 1646. The first abutting portion 1644 and the second abutting portion 1646 protrude in a second direction D2 perpendicular to the first direction D1. The main body 1642 extends in a third direction D3 perpendicular to the first direction D1 and the second direction D2 and connects the first abutting portion 1644 and the second abutting portion 1646. In the upper row terminal 16 as a whole, the fixed portion 164 extends in the third direction D3 while the contact portion 162 and the connection portion 166 extend in the third direction D3 from two opposite ends of the fixed portion 164 respectively. In the first direction D1, the upper row fixing hole 122 has a first inner sidewall 1222 and a second inner sidewall 1224 opposite to the first inner sidewall 1222. In the second direction D2, the upper row fixing hole 122 has a third inner sidewall 1226 and a fourth inner sidewall 1228 opposite to the third inner sidewall 1226, which are located between the first inner sidewall 1222 and the second inner sidewall 1224. The fixed portion 164 abuts against the upper row fixing hole 122 through the first abutting portion 1644 and the second abutting portion 1646 such that the upper row terminal 16 is fixed in the insulation housing 12 (i.e. the fixed portion 164 is fixed in the upper row fixing hole 122). In the embodiment, the upper row terminal 16 is inserted into the upper row fixing hole 122 in the third direction D3. The second abutting portion 1646 is located between the first abutting portion 1644 and the contact portion 162. Therefore, in principle, an outer dimension L1 of the first abutting portion 1644 in the second direction D2 is larger than an outer dimension L2 of the second abutting portion 1646 in the second direction D2, so that the upper row terminal 16 can be inserted smoothly into the upper row fixing hole 122 and the upper row fixing hole 122 can keep holding both the first abutting portion 1644 and the second abutting portion 1646.

In the embodiment, both the first abutting portion 1644 and the second abutting portion 1646 include two structures protruding from two sides of the main body 1642 in the second direction D2; thereby, both the first abutting portion 1644 and the second abutting portion 1646 can abut against the third inner sidewall 1226 and the fourth inner sidewall 1228 simultaneously. However, in practice, it is practicable that the first abutting portion 1644 or the second abutting portion 1646 can be a structure protruding from one side of the main body 1642 in the second direction D2 (e.g. the lower protruding structure of the fixed portion 164 which protrudes in the second direction D2 and abuts against the fourth inner sidewall 1228, while the upper side of the fixed portion 164 is modified to be flat and abuts against the third inner sidewall 1226).

Furthermore, in the embodiment, the upper row fixing hole 122 has two recesses 1227 and 1229 oppositely formed in the second direction D2 (extending in the direction D3), of which the widths (i.e. the intervals in the first direction D1) are substantially equal to the thickness of the upper row terminal 16 in the first direction D1 (for example, the thickness of the upper row terminal 16 would be the thickness of a metal strip by which the upper row terminal 16 is made). The structure design therefor makes the upper row terminal 16 to be inserted smoothly into the upper row fixing hole 122 and positioned therein. In practice, the fixed portion 164 can be accommodated in the recesses 1227 and 1229 only through the first abutting portion 1644 and the second abutting portion 1646. Furthermore, in the embodiment, the main body 1642 loosely fits in the upper row fixing hole 122, so the retaining force between the upper row terminal 16 with the upper row fixing hole 122 can be determined easily by controlling the structural interference of the first abutting portion 1644 and the second abutting portion 1646 with the upper row fixing hole 122 (i.e. the third inner sidewall 1226 and the fourth inner sidewall 1228 thereof). However, in practice, the main body 1642 also can be disposed to structurally interfere with the upper row fixing hole 122, which also can contributes to the retaining force. In addition, in FIG. 8, the section of the upper row terminal 16 is not up and down symmetrical relative to the upper row fixing hole 122, which is due to the fact that the first abutting portion 1644 is embedded in the fourth inner sidewall 1228 (i.e. by pushing down the fourth inner sidewall 1228), which also can be understood by FIG. 7 (i.e. a side view of a portion of the electrical connector 1).

In the embodiment, when the fixed portion 164 is fixed in the upper row fixing hole 122, the first side surface 164*a* faces the first inner sidewall 1222 and is kept away from the first inner sidewall 1222 by a first distance W1 and the second side surface 164*b* faces the second inner sidewall 1224 and is kept away from the second inner sidewall 1224 by a second distance W2, so that the first side surface 164*a* and the first inner sidewall 1222 can form an air band therebetween and so do the second side surface 164*b* and the second inner sidewall 1224. In practice, the first side surface 164*a* and the second side surface 164*b* are substantially parallel to the first inner sidewall 1222 and the second inner sidewall 1224 respectively. The impedance of the electrical connector 1 also can be adjusted (or changed) by designing the first distance W1 and the second distance W2. In practice, the first distance W1 and the second distance W2 can be designed but not limited to be equal to or larger than a third of an outer dimension W0 of the fixed portion 164 in the first direction D1 (i.e. the thickness of the fixed portion 164).

In the embodiment, the fixed portion 164 has a first through hole 1648 and a second through hole 1650, which pass through the first side surface 164*a* and the second side surface 164*b* in the first direction D1. When the fixed portion 164 is fixed in the upper row fixing hole 122, the first through hole 1648 and the second through hole 1650 are located in the upper row fixing hole 122. The impedance of the electrical connector 1 also can be adjusted (or changed) by designing the sizes of the first through hole 1648 and the second through hole 1650. In the embodiment, the first through hole 1648 and the second through hole 1650 are located at the first abutting portion 1644 and the second abutting portion 1646 respectively. Hole dimensions 1648*a* and 1650*a* of the first through hole 1648 and the second through hole 1650 in the second direction D2 respectively are larger than an outer dimension 1642*a* of main body 1642 in the second direction D2; the first through hole 1648 is larger than the second through hole 1650 (or the hole dimension 1648*a* is larger than the hole dimension 1650*a*). However, in practice the structural configuration is not limited thereto. For example, the first through hole 1648 and the second through hole 1650 can be formed somewhere else except for the first abutting portion 1644 and the second abutting portion 1646. For another example, the hole dimensions 1648*a* and 1650*a* can be determined by ordinary trials for a required impedance of the electrical connector 1.

In the embodiment, the upper row terminal 16 also includes a stop portion 168, which extends in the second direction D2 (or upward) from the connection portion 166. When the fixed portion 164 is fixed in the upper row fixing hole 122, the stop portion 168 abuts against the rear side 12*b* of the insulation housing 12, which serves as a positioning mechanism for the insertion of the upper row terminal 16 into the upper row fixing hole 122. By comparison, in the insertion process of the lower row terminal into the lower row fixing hole 124, a side surface 186*a* of the connection portion 186 of the lower row terminal 18 toward the insulation housing 12 abutting against the rear side 12*b* of the insulation housing 12 serves as a positioning mechanism. Furthermore, in the embodiment, after the lower row terminal 18 is inserted into the lower row fixing hole 124, the rear cover is assembled to the rear side 12*b* to cover the lower row fixing hole 124 and a portion of the connection portion 186 of the lower row terminal 18. At this moment, the fixed portion 184 of the lower row terminal 18 is invisible from the rear side 12*b*. The connection portion 166 of the upper row terminal 16 is exposed out of the rear cover 14 while the fixed portion 164 is covered by the stop portion 168 and the connection portion 166 in principle. The fixed portion 164 also can be regarded as being invisible in structure. Furthermore, the rear cover 14 also can provide positioning effect to the upper row terminal 16, so that the stop portion 168 can be omitted if a side surface 166*a* of the connection portion 166 toward the upper row terminal abutting against the rear cover 14 serves as a positioning mechanism.

Figure 8:
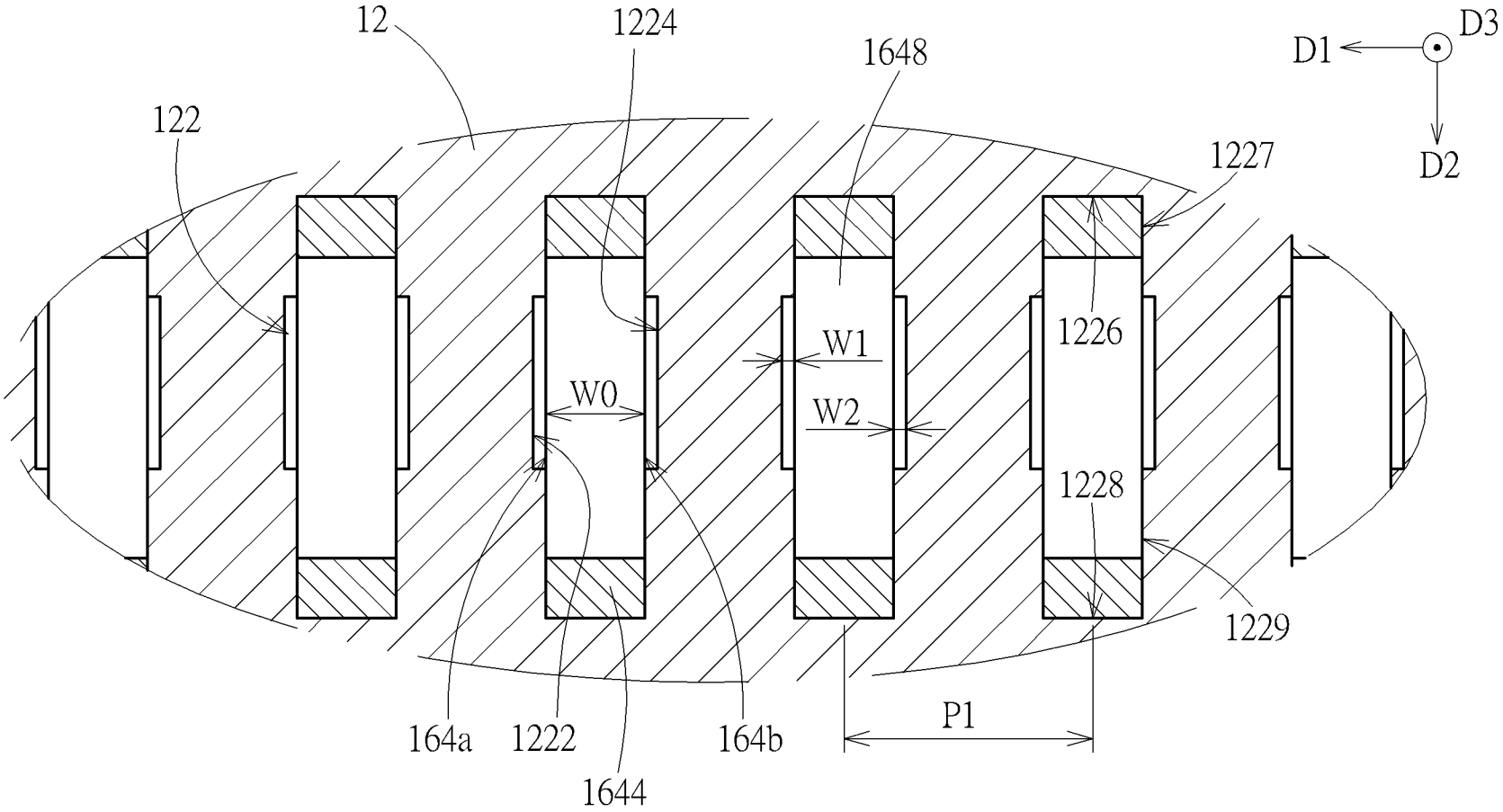
FIG. 8 is a sectional view of the electrical connector along the line Y-Y in FIG. 1.

Furthermore, in the embodiment, as shown by FIG. 1 and FIG. 8, the plurality of upper row terminals 16 are structurally identical and are arranged in the first direction D1 by a first pitch P1 (accordingly, so do the plurality of upper row fixing holes 122). The plurality of lower row terminals 18 are structurally identical and are in the first direction D1 by a second pitch P2 (accordingly, so do the plurality of lower row fixing holes 124). The first pitch P1 is equal to the second pitch P2. However, in practice the structural configuration is not limited thereto. For example, the upper row terminals 16 and the lower row terminals 18 are arranged in the first direction D1 by respective different pitches. In addition, the foregoing descriptions are based on the electrical connector 1 with two rows of terminals, but in practice, the foregoing descriptions are also applicable to an electrical connector with a single row of terminals. Furthermore, the foregoing descriptions are based on the female board electrical connector (i.e. the electrical connector 1), but in practice, the foregoing descriptions are also applicable to a male cable connector, or even an adapter, which will not be described in addition.

Figure 9:
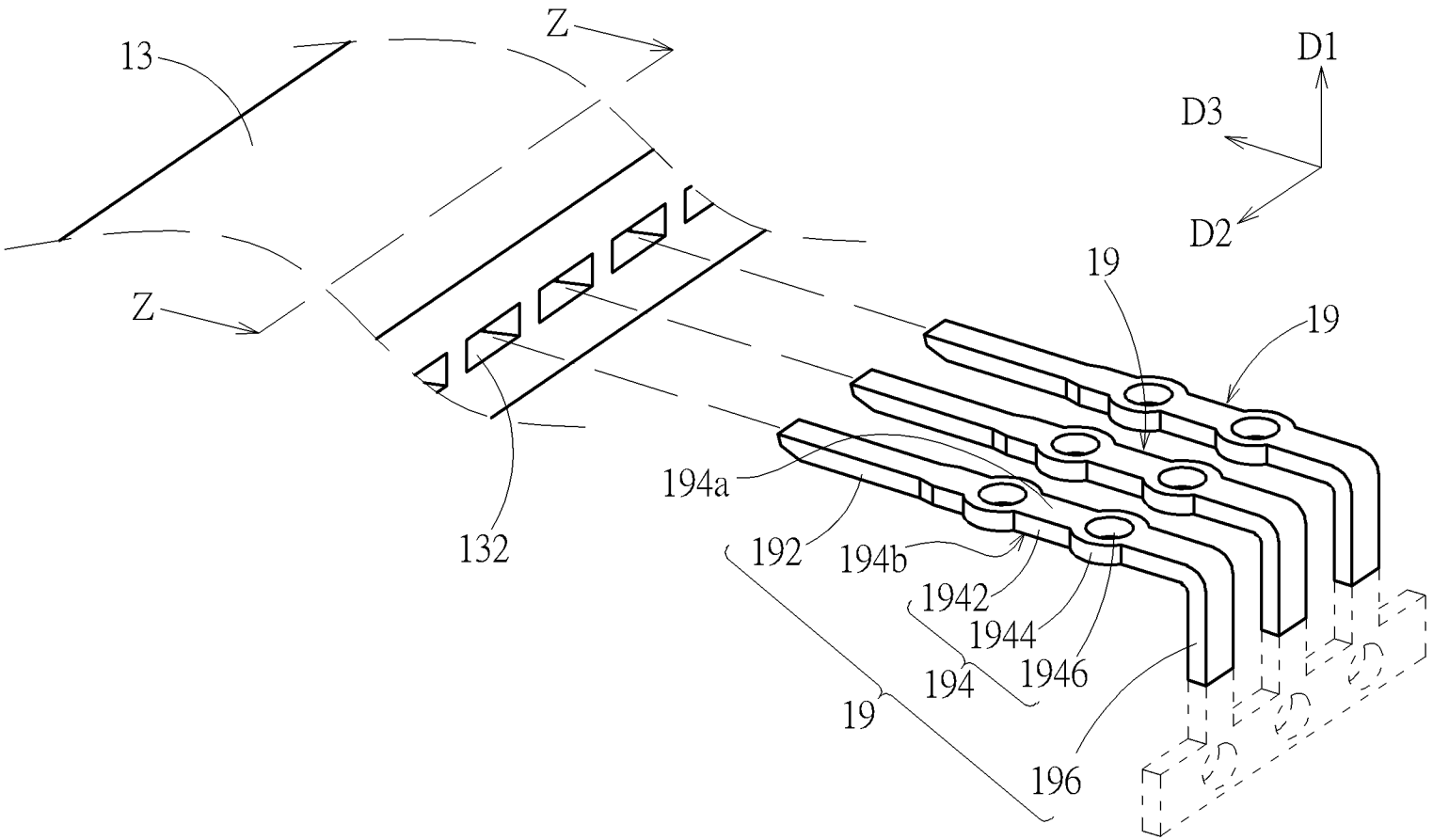
FIG. 9 is an exploded view of a portion of a simplified variant of the electrical connector in FIG. 1.
Figure 10:
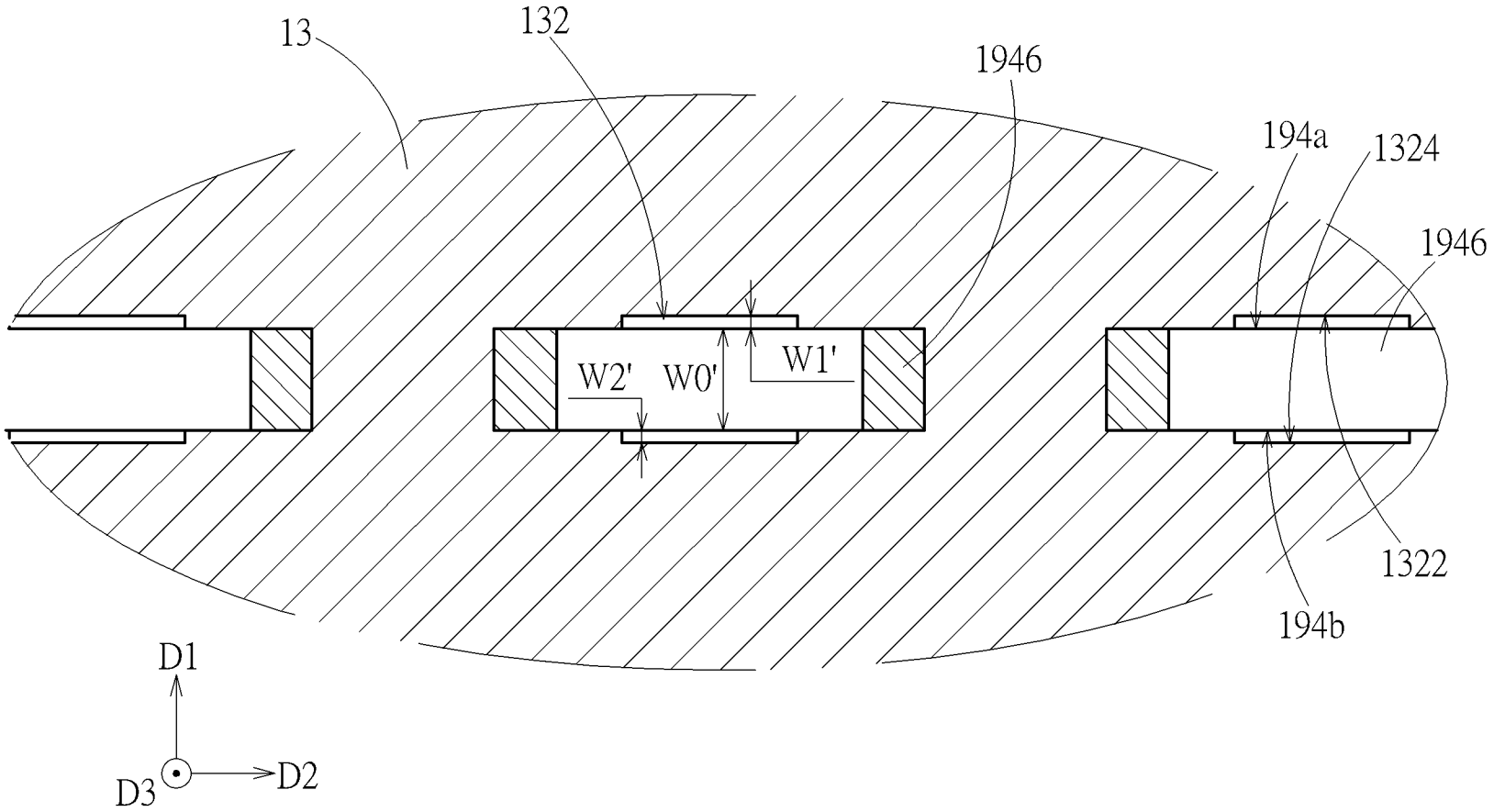
FIG. 10 is a sectional view of the variant along the line Z-Z in FIG. 9 after the components thereof are assembled.

In addition, in the embodiment, the upper row terminal 16 is provided in a plate structure and can be formed by cutting a metal strip in practice. The plate structure extends parallel to the second direction D2 and the third direction D3. Thereby, the plurality of upper row terminals 16 can be disposed parallel and non-coplanar in the insulation housing 12. However, in practice, the upper row terminal 16 can be formed by bending a plate structure. The above descriptions are also applicable to the lower row terminals 18, which will not be repeatedly described. Please refer to FIG. 9 and FIG. 10 which show a portion of a simplified variant of the electrical connector 1. The simplified variant is shown with a single row of terminals 19 for description simplification. As shown by FIG. 9 and FIG. 10, the terminal 19 is structurally equal to a simplified variant of the upper row terminal 16 (or the lower row terminal 18). Therefore, for other descriptions about the terminal 19 (and an insulation housing 13 to which the terminal 19 is assembled), please refer to the relevant descriptions of the upper row terminal 16 (or the lower row terminal 18), which will not be described in addition. The terminal 19 includes a contact portion 192, a fixed portion 194, and a connection portion 196. The contact portion 192 and the connection portion 196 extend in the third direction D3 from two opposite ends of the fixed portion 194. The fixed portion 194 has a first side surface 194*a* and a second side surface 194*b* opposite to the first side surface 194*a* in the first direction D1. The fixed portion 194 include a main body 1942, an abutting portion 1944, and a through hole 1946. The abutting portion 1944 is connected to the main body 1942 and protrudes in the second direction D2. The through hole 1946 is located at the abutting portion 1944 and passes through the first side surface 194*a* and the second side surface 194*b*. Therein, the fixed portion 194 is fixed in a fixing hole 132 of the insulation housing 13 through the abutting portion 1944. The fixing hole 132 has a first inner sidewall 1322 toward the first side surface 194*a* and a second inner sidewall 1324 toward the second side surface 194*b*. The first side surface 194*a* is kept away from the first inner sidewall 1322 by a first distance W1'. The second side surface 194*b* is kept away from the second inner sidewall 1324 by a second distance W2'. A sum of the first distance W1' and the second distance W2' is larger than a third of an outer dimension W0' of the fixed portion 194 in the first direction D1. In the terminal 19 as a whole, the terminal 19 is provided in a bent plate structure (which is bent in a direction perpendicular to the second direction D2). Adjacent two of the terminals 19 are arranged in the second direction D2 (i.e. to be coplanar) and are fixed in the corresponding fixing holes 132. The structure configuration is conducive to producing the terminals 19 in a way of continuous stamping (that is, the terminals 19 are all connected to a carrier strip shown in dashed lines in FIG. 9) and facilitates the insertion of the terminals 19 into the fixing holes 132 of the insulation housing at the same time, which reduces the assembly cost. In practice, the combination of the terminals 19 and the insulation housing 13 assembled therewith can be expanded to be provided in a structure with two rows of terminals according to the relevant descriptions of the electrical connector 1 in the foregoing, which will not be described in addition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical connector, comprising:

an insulation housing having a first fixing hole, the first fixing hole having a first inner sidewall and a second inner sidewall opposite to the first inner sidewall; and a first terminal comprising a contact portion, a fixed portion, and a connection portion, the contact portion and the connection portion extending from the fixed portion respectively and being exposed from the insulation housing, the fixed portion having a first side surface and a second side surface opposite to the first side surface in a first direction, the fixed portion having a first through hole, the fixed portion being fixed in the first fixing hole, the first through hole being located in the first fixing hole, the first side surface facing the first inner sidewall and being kept away from the first inner sidewall by a first distance, the second side surface facing the second inner sidewall and being kept away from the second inner sidewall by a second distance, the fixed portion comprising a first abutting portion and a main body connected to the first abutting portion, the first abutting portion protruding in a second direction perpendicular to the first direction and abutting against the first fixing hole, the first through hole being located at the first abutting portion, the main body extending perpendicular to the first direction and the second direction, a hole dimension of the first through hole in the second direction being larger than an outer dimension of the main body in the second direction;

wherein the fixed portion, the first distance, and the second distance are dimensioned for adjustment to an impedance of the electrical connector.

2. The electrical connector of claim 1, wherein the first through hole passes through the first side surface and the second side surface in the first direction.

3. The electrical connector of claim 1, wherein a sum of the first distance and the second distance is larger than a third of an outer dimension of the fixed portion in the first direction.

4. The electrical connector of claim 1, wherein the fixed portion comprises a second abutting portion, the main body connects the first abutting portion and the second abutting portion, the second abutting portion protrudes in the second direction and abuts against the first fixing hole, the main body loosely fits in the first fixing hole, the second abutting portion is located between the first abutting portion and the contact portion, and an outer dimension of the first abutting portion in the second direction is larger than an outer dimension of the second abutting portion in the second direction.

5. The electrical connector of claim 4, wherein the fixed portion has a second through hole located at the second abutting portion.

6. The electrical connector of claim 5, wherein the first through hole is larger than the second through hole.

7. The electrical connector of claim 1, wherein the fixed portion extends in a third direction perpendicular to the first direction, and the contact portion and the connection portion extend in the third direction from two opposite ends of the fixed portion respectively.

8. The electrical connector of claim 1, further comprising a second terminal identical to the first terminal, where the insulation housing has a second fixing hole identical to the first fixing hole, and the second terminal is fixed in the second fixing hole adjacent to the first terminal in the first direction.

9. The electrical connector of claim 1, further comprising a second terminal identical to the first terminal, wherein the insulation housing has a second fixing hole identical to the first fixing hole, the second terminal is fixed in the second fixing hole adjacent to the first terminal in a direction perpendicular to the first direction.

10. The electrical connector of claim 1, further comprising a rear cover, wherein the insulation housing has a front side and a rear side, the contact portion is exposed at the front side, the connection portion is exposed at the rear side, and the rear cover is attached to the rear side to cover the first fixing hole and a portion of the connection portion.

11. A terminal used in an electrical connector, the terminal comprising:

a fixed portion, the fixed portion having a first side surface and a second side surface opposite to the first side surface in a first direction, the fixed portion having a first abutting portion and a first through hole, the first abutting portion protruding in a second direction perpendicular to the first direction, the first through hole being located at the first abutting portion and passing through the first side surface and the second side surface, the fixed portion comprising a main body, the main body extending perpendicular to the first direction and the second direction and being connected to the first abutting portion, a hole dimension of the first through hole in the second direction being larger than an outer dimension of the main body in the second direction, wherein the fixed portion is fixed in the electrical connector through the first abutting portion;

a contact portion extending from the fixed portion; and a connection portion extending from the fixed portion.

12. The terminal of claim 11, wherein the fixed portion comprises a second abutting portion, the main body connects the first abutting portion and the second abutting portion, the second abutting portion is located between the first abutting portion and the contact portion, an outer dimension of the first abutting portion in the second direction is larger than an outer dimension of the second abutting portion in the second direction, and the fixed portion is fixed in the electrical connector through the first abutting portion and the second abutting portion.

13. The terminal of claim 12, wherein the fixed portion has second through hole located at the second abutting portion.

14. The terminal of claim 13, wherein the first through hole is larger than the second through hole.

15. The terminal of claim 11, wherein the fixed portion extends in a third direction extend perpendicular to the first direction and the second direction, and the contact portion and the connection portion extend in the third direction from two opposite ends of the fixed portion respectively.

* * * * *